US005173637A

United States Patent [19]

Sica

[11] Patent Number: 5,173,637

[45] Date of Patent: Dec. 22, 1992

[54] FLUORESCENT LAMP WITH PROTECTIVE ASSEMBLY

[75] Inventor: Michael F. Sica, Brooklyn, N.Y.

[73] Assignee: Royal Lite Manufacturing and Supply Corp., Belleville, N.J.

[21] Appl. No.: 887,350

[22] Filed: May 21, 1992

Related U.S. Application Data

[63] Continuation of Ser. No. 555,912, Jul. 19, 1990, abandoned.

[51] Int. Cl.[5] ..... H01J 61/30

[52] U.S. Cl. ..... 313/489; 313/493; 313/634; 313/25; 313/635

[58] Field of Search ..... 313/489, 493, 634, 635, 313/25, 258, 486, 110

[56] References Cited

U.S. PATENT DOCUMENTS 3,358,167 12/1967 Shanks ..... 313/25
3,602,759 8/1971 Evans ..... 313/488 X
3,808,495 4/1974 Win ..... 313/258 X
4,048,537 9/1977 Blaisdell et al. ..... 313/489
4,924,368 5/1990 Northrop et al. ..... 313/110 X

*Primary Examiner*—Donald J. Yusko
*Assistant Examiner*—Ashok Patel
*Attorney, Agent, or Firm*—Brumbaugh, Graves, Donohue & Raymond

[57] ABSTRACT

A fluorescent lamp includes a protective cover assembly having a protective tube preformed of a semi-rigid non-frangible transparent polymeric material and received over the glass tube with a clearance between the outer surface of the glass tube and inner surface of the protective tube and extending lengthwise substantially coextensively with the glass tube and a collar preformed of a heat-shrinkable polymeric material received in overlapping relation over a portion of the protective sleeve at each end thereof and over the flange portion of the adjacent cap, the collar being heat-shrunk into sealed relation with the protective tube and the cap flange portion.

1 Claim, 1 Drawing Sheet

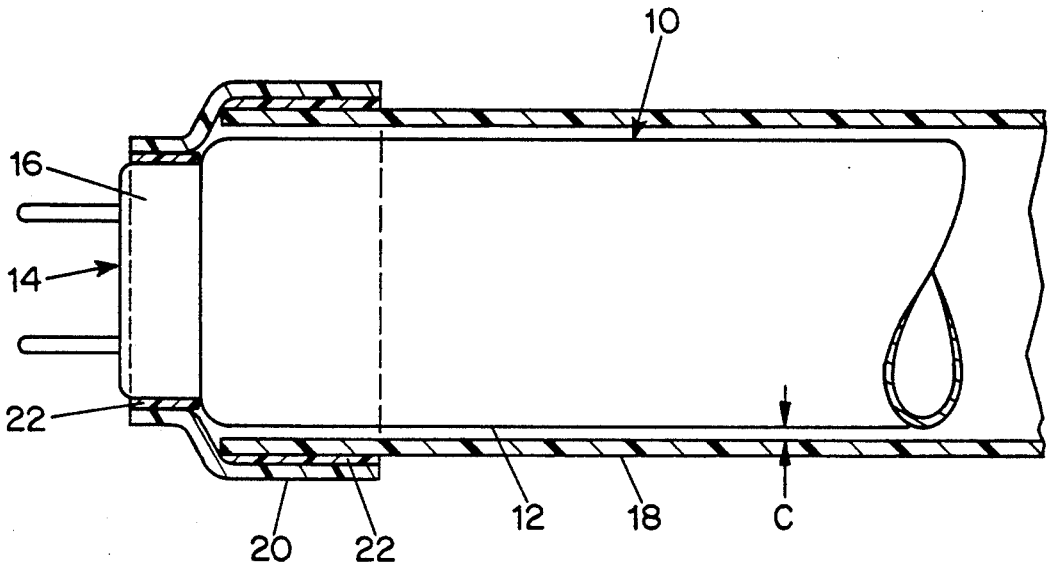
10
16
14
22
20
22
12
18
C

FLUORESCENT LAMP WITH PROTECTIVE ASSEMBLY

This application is a continuation of application Ser. No. 07/555,912, filed on Jul. 19, 1990 now abandoned.

BACKGROUND OF THE INVENTION

When a fluorescent lamp breaks, fragments of the glass tube and powders from the phosphor coating inside the tube are scattered. In many situations in which fluorescent lighting is used, the food processing industry being a particularly prevalent example, the glass fragments and phosphor powders present an environmental hazard. To prevent glass fragments and powders from scattering, it is well-known to provide a protective plastic coating directly onto the external surface of the glass tube. While such a coating inhibits scattering of materials from a broken lamp, the presently available "safety" type fluorescent lamps become discolored, especially near the ends where the light output from the lamp is highly ultraviolet, within a few days of being placed in service. The discoloration reduces the light output of the lamp and is aesthetically displeasing. Also, the coating over the glass envelope does not always retain the metal caps intact with the fragmented glass tube, and glass fragments and powder can be released if a cap separates.

SUMMARY OF THE INVENTION

An object of the present invention is to provide a fluorescent lamp having very effective protection against scattering of glass fragments from the tube and powders from the coating in the event that the lamp breaks A further object is to provide such protection in a way that does not reduce the light output during the useful life of the lamp due to discoloration or clouding of the protective element. Still another object is to provide a "safety" fluorescent lamp that is easy and inexpensive to produce. The foregoing and other objects are attained, according to the present invention, by a protective cover assembly comprising a semi-rigid non-frangible protective tube preformed of a transparent polymeric material and received over the glass tube of the lamp with a clearance between the outer surface of the glass tube and the inner surface of the protective tube and extending lengthwise substantially coextensively with the glass tube and a collar preformed of a heat-shrinkable polymeric material received in overlapping relation over a portion of the protective sleeve at each end thereof and over the flange portion of the adjacent cap, the collar being heat-shrunk into sealed relation with the protective tube and the cap flange portion In a preferred embodiment of the invention a layer of an adhesive is interposed between each collar and the corresponding end of the protective tube and the corresponding cap flange portion.

For a better understanding of the invention reference may be made to the following description of an exemplary embodiment, taken in conjunction with the accompanying drawing.

DESCRIPTION OF THE DRAWING

The drawing is a partial side cross-sectional view of an embodiment of a protective assembly as installed on a conventional fluorescent lamp.

DESCRIPTION OF THE EMBODIMENT

Reference numeral 10 designates a conventional, commercially available fluorescent lamp of the type having an elongated glass tube 12 that necks down slightly at each end is closed at each end by a cup-like end cap 14 having a peripheral flange portion 16. The protective assembly consists of a protective tube 18 performed from a semi-rigid non-flangible transparent polymeric material and received over the glass tube with a clearance "c" between the outer surface of the glass tube and the inner surface of the protective tube and extending lengthwise substantially coextensively with the glass tube and a collar 20 preformed from a heat-shrinkable polymerica material received in overlapping relation over a portion of the protective sleeve at each end thereof and over the flange portion of the adjacent cap. The collar is heat-shrunk into sealed relation with the protective tube and the cap flange portion. A layer 22 of an adhesive is interposed between each collar and the corresponding end of the protective tube and the corresponding cap flange portion The adhesive layer is not present between the glass tube of the lamp and the collars.

In a specific example of the invention, as applied to a 1.50 in. diameter fluorescent tube, the protective tube 18 is a piece cut to a length such as to extend over the full diameter portion of the lamp tube (but not over the necked-down parts at either end) from an extrusion of a polycarbonate resin that is highly stabilized against ultra-violet radiation. The tubing is available commercially from Thermoplastic Processors, Incorporated, of Sterling, N.J., as Product No. 58UV, which is manufactured from a resin supplied by Mobay, Incorporated (Resin No. 3207-1112M50). The protective tube has a wall-thickness of 0.015 in., an inside diameter of 1.517 in. and an outside diameter of 1.547 in. Therefore, on the diameter, the clearance between the outside of the glass tube and the inside of the protective tube is 0.017 in. The clearance is desirable in that it provides a thermal insulating barrier between the glass tube and the protective tube that keeps the protective tube from being highly heated. Also, it facilitates assembling the protective tube onto a finished lamp. The collars 20 are pieces cut to a length of 1.5 in. from a tubing product available commercially from E. H. Canis & Son, Inc., of Metuchen, N.J., under the trademark "Astramelt." About 1.0 in. of the collar overlaps the protective tube lengthwise. The adhesive is 3M No. 4693 and provides additional mechanical retention over and above that provided by shrinking the collar and also provides a moisture barrier and hermetic seal between the lamp and the protective assembly.

If the protected lamp breaks, the protective assembly retains the caps and prevents the dispersal of glass fragments and phosphor powders. The protective assembly does not appear to reduce the light transmission, because the protective tube is entirely transparent The protective tube of an experimental assembly according to the above example has shown no tendency to discolor after a year in service.

I claim:

1. In a fluorescent lamp of the type having an elongated glass tube and metal caps at each end, each cap having a peripheral flange portion, the improvement of a protective cover assembly comprising a protective tube preformed of a semi-rigid non-flangible transparent polymeric material that is highly stabilized against ultraviolet radiation and is received over the glass tube with a clearance between the outer surface of the glass tube and the inner surface of the protective tube and extending lengthwise substantially coextensively with the glass tube, a collar preformed of a heat-shrinkable polymeric material received in overlapping relation over a portion of the protective sleeve at each end thereof and over the flange portion of the adjacent metal cap of the lamp, the collar being heat-shrunk into sealed relation with the protective tube and the cap flange portion, a layer of an adhesive interposed between each collar and the corresponding end of the protective tube and a layer of an adhesive interposed between the collar and the corresponding cap flange portion.

* * * * *